US006789275B2

(12) United States Patent
Spells, Sr. et al.

(10) Patent No.: US 6,789,275 B2
(45) Date of Patent: Sep. 14, 2004

(54) NON-LEAKING FLUSH TOILET SYSTEM

(76) Inventors: Michael W. Spells, Sr., 2416 S. Rotherwood Ave., Evansville, IN (US) 47714; Al Brandt, 2416 S. Rotherwood Ave., Evansville, Vanderburgh County, IN (US) 47714; Jesse M. Spells, Jr., 2416 S. Rotherwood Ave., Evansville, Vanderburgh County, IN (US) 47714

( * ) Notice: Subject to any disclaimer, the term of this patent is extended or adjusted under 35 U.S.C. 154(b) by 0 days.

(21) Appl. No.: 10/225,524

(22) Filed: Aug. 20, 2002

(65) Prior Publication Data

US 2003/0033662 A1 Feb. 20, 2003

Related U.S. Application Data

(60) Provisional application No. 60/313,682, filed on Aug. 20, 2001.

(51) Int. Cl.[7] ..... E03D 11/16

(52) U.S. Cl. ..... 4/252.5; 4/252.1; 4/252.4; 4/252.6; 285/56

(58) Field of Search ..... 4/252.1–252.6; 285/56–60

(56) References Cited

U.S. PATENT DOCUMENTS 807,265 A * 12/1905 Gutelius ..... 4/252.4
1,042,465 A * 10/1912 Oakes ..... 285/58
3,224,014 A * 12/1965 Pietrzak ..... 4/252.6
3,311,391 A * 3/1967 Harrell ..... 285/58
3,479,060 A * 11/1969 Westbrook et al. ..... 285/58
4,059,289 A * 11/1977 Morris et al. ..... 285/56
4,547,005 A * 10/1985 Soederhuyzen ..... 285/58
4,918,761 A * 4/1990 Harbeke ..... 4/252.4
5,291,619 A * 3/1994 Adorjan ..... 4/252.6
5,937,450 A * 8/1999 Jones ..... 4/252.1
6,065,160 A * 5/2000 Winn ..... 4/252.1
6,438,765 B1 * 8/2002 Johnson et al. ..... 4/252.4

* cited by examiner

*Primary Examiner*—Henry Bennett
*Assistant Examiner*—Amanda Flynn
(74) *Attorney, Agent, or Firm*—Gary K. Price, Esq.

(57) ABSTRACT

A non-leaking flush toilet system that eliminates the need for using wax gaskets or rings on a toilet system. Such system having a substantially flat surface that is affixed to the base outlet opening of a flush toilet. The toilet system further includes an upper portion having inner and outer clearance surfaces, and an extension member that projects downwardly from the upper portion. Attached to the exterior surface of the extension member is a sealing boot. The sealing boot having a plurality of sealing lips that outwardly extend from the sealing boot's outer surface. In use, the outer clearance surface is received inside the floor flange, and the outer surface of the extension member having the sealing boot disposed thereon is sealingly received inside the soil pipe, thereby forming a seal between the base of the toilet and the floor flange.

21 Claims, 2 Drawing Sheets

NON-LEAKING FLUSH TOILET SYSTEM

CROSS REFERENCES TO RELATED APPLICATIONS

U.S. Provisional Application for Patent No. 60/313,682, filed Aug. 20, 2001, with title, "Non-Leaking Flush Toilet System" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to an apparatus that eliminates the need for using wax gaskets or rings to seal a toilet base to a soil pipe in a toilet system. More specifically, it relates to a toilet base extension sleeve having a sealing boot thereon that sealably fits within a standard floor flange and soil pipe.

2. Brief Description of Prior Art

Prior art methods for preventing the base of the toilet bowl from leaking primarily involve using a wax gasket or ring between the base of the flush toilet and the floor flange to create a seal between the toilet base and the floor flange at or about the floor surface. Such wax gaskets have a relatively short life, and will eventually crack or break, causing leaks, often hidden leaks. Such leaks often go undetected until considerable damage has been caused due to moisture, mold, mildew, and/or rust. The property owner is then required to physically remove the toilet from the floor in order to replace the cracked or broken wax gasket. Such process includes using a putty knife to remove the old wax gasket from the base of the toilet and the floor flange. This process is difficult, inconvenient, and relatively unsanitary.

As will be seen from the subsequent description, the preferred embodiments of the present invention overcome these and other shortcomings of prior art.

SUMMARY OF THE INVENTION

The present invention is designed to eliminate the need for using wax gaskets on toilet systems. The preferred embodiment having a substantially flat surface that is affixed to the base outlet opening of a flush toilet. The system further includes an upper portion having an inner clearance surface and an outer clearance surface, and an extension member that projects downwardly from the upper portion. Attached to the outer surface of the extension member is a sealing boot having a plurality of sealing lips that extend outwardly from the outer surface of the sealing boot and continue the outer circumference of the sealing boot.

DESCRIPTION OF THE PREFERRED EMBODIMENT

Figure 1:
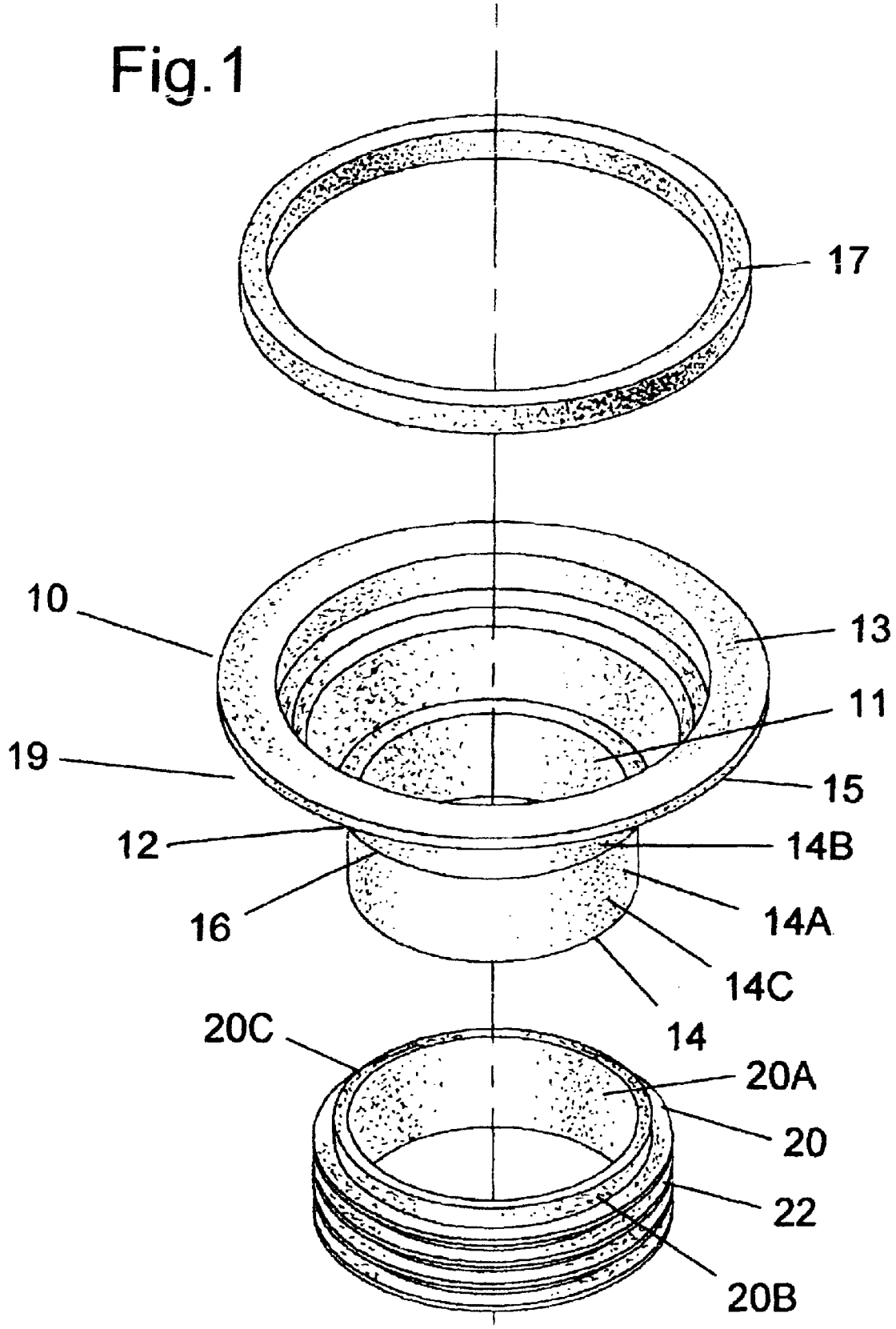
FIG. 1 is a perspective view of the components of the present invention namely, an extension member, a sealing boot, and an adhesive ring.
Figure 2:
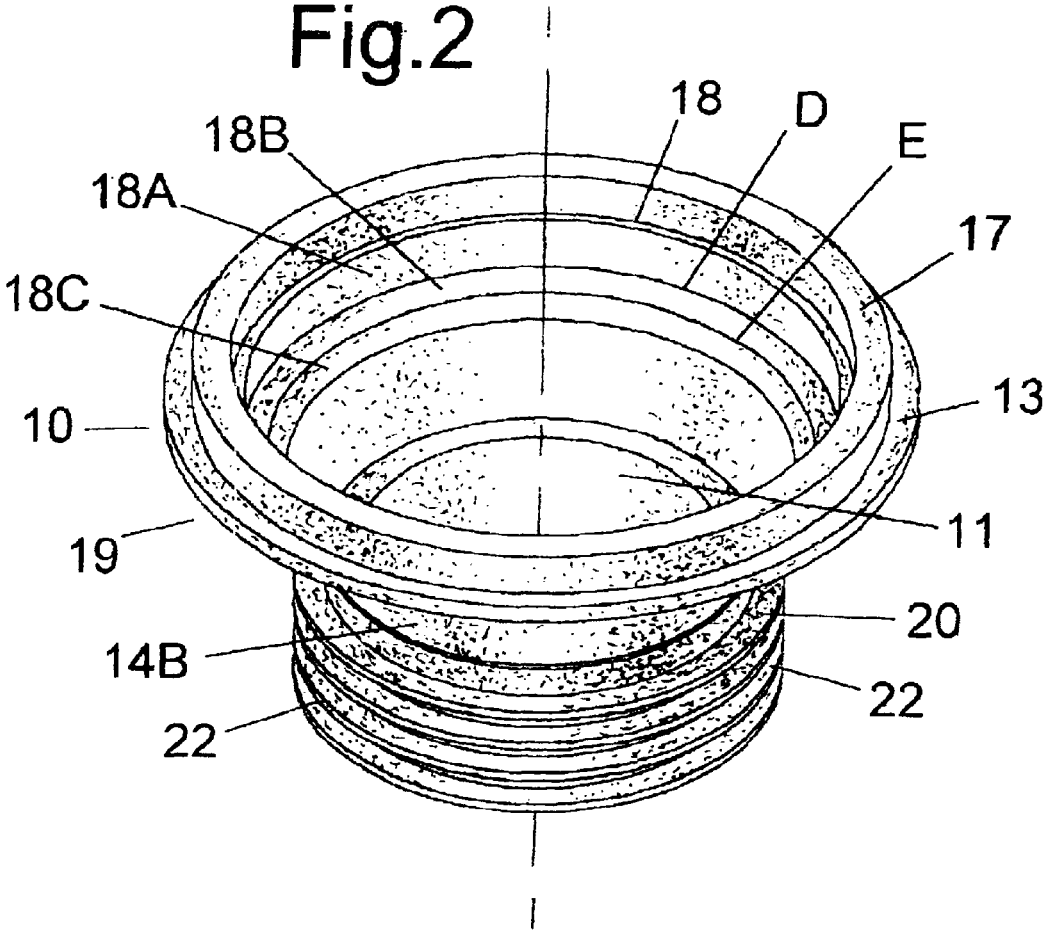
FIG. 2 is an elevational perspective view of the extension sleeve of FIG. 1.
Figure 3:
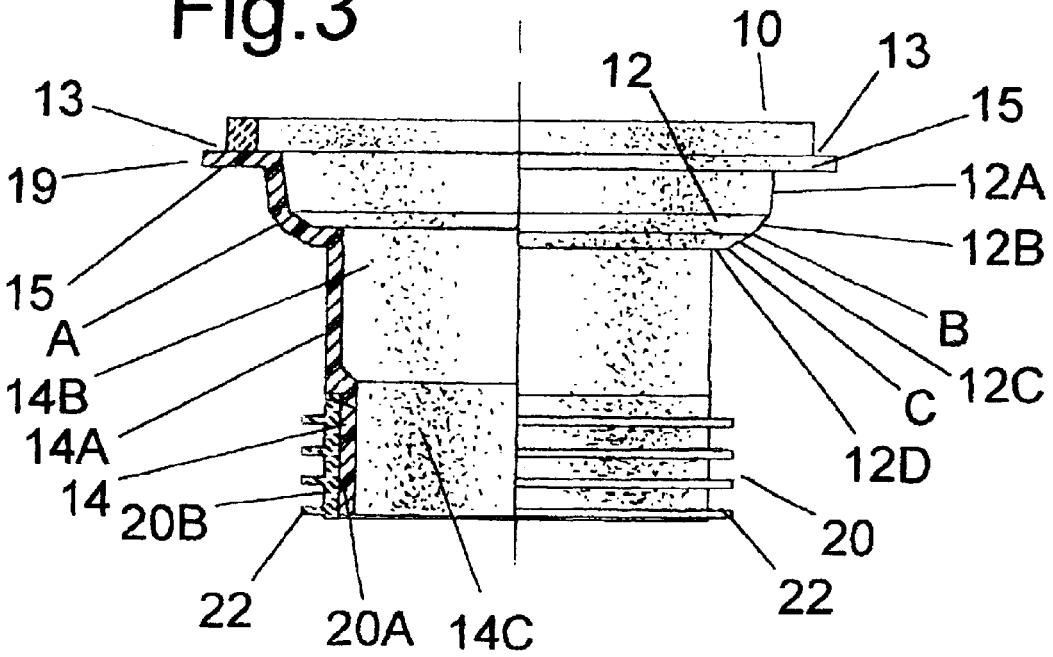
FIG. 3 is a section side view of the extension sleeve of FIG. 2.

FIGS. 1–3 illustrate the preferred embodiment of a toilet base extension sleeve 10 made in accordance with the present invention. As best shown in FIGS. 1 and 3, the toilet base extension sleeve 10 includes a mounting face 13, an extension member 14 having an outer surface 14A, an upper portion 19 having an inner clearance surface 18 and an outer clearance surface 12, and a lower face 15. The extension member 14 has a cylindrical shape that defines a drain clearance 11 therein. As best shown in FIGS. 1 and 3, the extension member 14 further including a top portion 14B and a lower portion 14C, wherein the diameter of the top portion 14B is slightly larger than the diameter of the lower portion 14C defining a shoulder 16.

As best shown in FIG. 3, the upper portion 19 of the sleeve 10 is primarily that area between the lower face 15 and the top portion 14B of the extension member 14.

Referring to FIG. 3, the outer clearance surface 12 consists substantially of four (4) flat surfaces designated as 12A, 12B, 12C, and 12D that define the outer clearance sealing surface 12. In general, said flat surfaces 12A, 12B, 12C, 12D are critically angled to create necessary clearance so that the extension sleeve 10 will fit within a variety of standard floor flanges. The inventors have found that angle designated as A formed by the relationship of flat surface 12A to flat surface 12B is approximately 10 degrees; the angle designated as B formed by the relationship of flat surface 12B to flat surface 12C is approximately 30 degrees; and, the angle designated as C formed by the relationship of flat surface 12C to flat surface 12D is approximately 60 degrees.

As shown in FIGS. 1 and 2, the inner clearance surface 18 consists substantially of three (3) flat surfaces designated as 18A, 18B and 18C that define the inner clearance surface 18. In general, said flat surfaces 18A, 18B, 18C of the inner extension sealing surface 18 are critical in relation to the flat surfaces 12A, 12B, 12C, and 12D of the outer extension sealing surface 12 so that the upper portion 19 is of proper wall thickness, and to create necessary clearance so that the extension sleeve 10 will receive a variety of flush toilet base outlet openings, also often referred to as toilet horns. Referring to FIG. 2, the inventors have found that angle designated as D formed by the relationship of flat surface 18A to flat surface 18B is approximately 12 degrees; and, the angle designated as E formed by the relationship of flat surface 18B to flat surface 18C is approximately 60 degrees.

A standard flush toilet (not shown) includes a toilet base, and a base outlet opening.

The toilet base extension sleeve 10 is mounted to the toilet base so that the drain clearance 11 is coincident with the base outlet opening of the toilet base, by aligning and affixing the mounting face 13 of the toilet base extension sleeve 10 to the toilet base. The mounting face 13 of the sleeve 10 is a substantially flat surface and is affixed to the toilet base with an adhesive ring 17, said adhesive ring 17 preferably constructed of any adhesive material suitable for bonding plastic to porcelain. Once the extension sleeve 10 is attached to the toilet base as described above, the extension member 14 of the toilet base extension sleeve 10 extends from the toilet base of the flush toilet. As will be discussed, water flushing from the toilet will pass through the base outlet opening of the toilet down through the drain clearance 11 of the sleeve 10.

The lower portion 14C of the extension member 14 is slidingly positioned within a sealing boot 20, said sealing boot 20 having an inner surface 20A, an outer surface 20B and a top surface 20C. Specifically, the outer surface 14A of the lower portion 14C of the downwardly projecting extension member 14 is in sealing relationship with the inner surface 20A of the sealing boot 20. As shown in the drawings, said sealing boot 20 further including a plurality of sealing lips 22. Said sealing lips 22 extend outwardly from the outer surface 20B of the sealing boot 20, and continue the outer circumference of the boot 20. Said sealing boot 20 having a sufficient thickness so that the lower portion 14C of the extension member 14, having the sealing boot 20 thereon, sealingly fits within the soil pipe. An air tight seal is formed between the inner surface of the soil pipe and the outer surface 20B of the sealing boot 20. Such air tight seal is enhanced at locations where the soil pipe surface meets the plurality of sealing lips 22. A standard floor flange (not shown) is typically adapted to mount to a standard soil pipe. In use, the toilet base extension sleeve 10 is first affixed to the toilet base of the flush toilet as previously discussed. The sealing boot 20 is then attached to the lower portion 14C of the extension member 14 by slidably attaching the inner surface 20A of the sealing boot 20 to the outer surface 14A of the extension member 14 as described above. When properly attached, the top end 20C of the sealing boot 20 abuts the shoulder 16 of the extension member 14.

The toilet is then attached to the standard floor flange by conventional closet bolts (not shown). When the toilet is lowered onto the floor flange, the extension member 14 of the sleeve 10 is advanced into the floor flange. The extension member 14 of the sleeve 10 extends from the base outlet opening of the toilet base, downthrough the floor flange so that the sealing boot 20 attached to the lower portion 14C of the extension member 14 slidably fits within the soil pipe. An air tight seal is formed between the inside of the soil pipe and the outer surface 20B of the sealing boot 20. Such air tight seal is enhanced at locations where the soil pipe surface meets the plurality of sealing lips 22. Thus, water flushing from the toilet flows through the opening of the toilet, through the drain clearance 11 of the sleeve 10, directly into the soil pipe.

Although the description above contains many specificities, these should not be construed as limiting the scope of the invention but as merely providing illustrations of a presently preferred embodiment of this invention.

Thus the scope of the invention should be determined by the appended claims in the formal application and their legal equivalents, rather than by the examples given.

We claim:

1. A toilet base extension sleeve for sealably attaching a flush toilet to a standard floor flange and soil pipe, said toilet base extension sleeve comprising:

a mounting face having a substantially flat surface for mating with a toilet outlet of the flush toilet, an upper portion having an inner clearance surface and an outer clearance surface, an extension member having a cylindrical shape defining a drain clearance, said extension member further including an outer surface, a top portion, and a lower portion, said top portion having a diameter larger than the diameter of the lower portion defining a shoulder, a lower face, and a sealing boot having an inner surface, an outer surface, top surface, and a plurality of sealing lips that extend outwardly from the outer surface of the sealing boot, said sealing boot attached to the outer surface of the lower portion of the extension member, wherein the upper portion of the extension sleeve is sealingly received inside said floor flange, wherein the lower portion of the extension member is sealingly received inside the soil pipe said lips forming a plurality of seal enhancing locations with said soil pipe.

2. The toilet base extension sleeve as recited in claim 1, wherein the outer clearance surface includes a first surface, a second surface, a third surface and a fourth surface, and the inner clearance surface includes a fifth surface, a sixth surface and a seventh surface.

3. The toilet base extension sleeve as recited in claim 2, wherein a first angle formed by the relationship of the first surface to said second surface is approximately 10 degree.

4. The toilet base extension sleeve in claim 2, wherein a second angle formed by the relationship of the second surface to said third surface is approximately 30 degrees.

5. The toilet base extension sleeve as recited in claim 2, wherein a third angle formed by the relationship of said third surface to said fourth surface is approximately 60 degrees.

6. The toilet base extension sleeve as recited in claim 2, wherein a fourth angle formed by the relationship of said fifth surface to said sixth surface is approximately 12 degrees.

7. The toilet base extension sleeve as recited in claim 2, wherein a fifth angle formed by the relationship of said sixth surface to said seventh surface is approximately 60 degrees.

8. A sealing kit for connecting a flush toilet to a soil pipe, said sealing kit comprising:

a mounting face having a substantially flat surface for mating with a toilet outlet, an upper portion projecting downwardly from the mounting face, a substantially cylindrical extension member projecting downwardly from said upper portion and defining an outer surface, and a substantially cylindrical sealing boot defining an outer surface and having a plurality of sealing lips that extend outwardly from the outer surface of the sealing boot, wherein the outer surface of the extension member is sealingly received inside the sealing boot, and wherein the outer surface of the sealing boot is sealingly received inside the soil pipe said sealing lips forming a plurality of seal enhancing locations with said soil pipe, and wherein said upper portion includes a sealing surface adapted to form a seal with a floor flange.

9. A sealing kit for connecting a flush toilet to a floor flange and a soil pipe, said sealing kit comprising:

a mounting face having a substantially flat surface for mating with a toilet outlet, an upper portion defining an outer clearance surface, a substantially cylindrical extension member projecting downwardly from said upper portion and defining an outer surface, and a substantially cylindrical sealing boot defining an outer surface and having a plurality of sealing lips that extend outwardly from the outer surface of the sealing boot, wherein the outer clearance surface is received inside the floor flange, wherein the outer surface of the extension member is sealingly received inside the sealing boot, and wherein the outer surface of the sealing boot is sealingly received inside the soil pipe said sealing lips forming a plurality of seal enhancing locations with said soil pipe, and wherein said outer clearance surface includes a sealing surface adapted to form a seal with a floor flange.

10. The sealing kit as recited in claim 9, wherein the outer clearance surface includes a first surface, a second surface, a third surface, and a fourth surface.

11. The sealing kit as recited in claim 10, wherein a first angle formed by the relationship of said first surface to said second surface is approximately 10 degrees.

12. The sealing kit as recited in claim 10, wherein a second angle formed by the relationship of said second surface to said third surface is approximately 30 degrees.

13. The sealing kit as recited in claim 10, wherein a third angle formed by the relationship of said third surface to said fourth surface is approximately 60 degrees.

14. A toilet base extension sleeve for sealably attaching a flush toilet having a horn to a floor flange and soil pipe, said toilet base extension sleeve comprising:

a mounting face having a substantially flat surface for mating with a toilet outlet of the flush toilet, an upper portion adjacent the mounting face having an inner clearance surface and an outer clearance surface, an extension member having a cylindrical shape defining a drain clearance, said extension member further including an outer surface, a top portion, and a lower portion, said lower portion having a plurality of sealing lips, wherein the extension member projects from said mounting face, wherein the upper portion of the extension sleeve is sealingly received inside said floor flange, wherein the lower portion of the extension member is sealingly received inside the soil pipe, said lips forming a plurality of seal enhancing locations with said soil pipe.

15. The extension sleeve as recited in claim 14, wherein said mounting face includes adhesive to attach said mounting face to said toilet.

16. The toilet base extension sleeve as recited in claim 14, wherein the outer clearance surface includes a first surface, a second surface, a third surface and a fourth surface, and the inner clearance surface includes a fifth surface, a sixth surface and a seventh surface.

17. The toilet base extension sleeve as recited in claim 16, where at least one of said first, second, third and fourth surfaces forms a seal with said floor flange.

18. The toilet base extension sleeve as recited in claim 16, wherein at least one of said fifth, sixth and seventh surfaces forms a seal with said toilet.

19. A toilet base extension sleeve for sealably attaching a flush toilet having a horn to a floor flange and soil pipe, said toilet base extension sleeve comprising:

a mounting face having a surface for mating with a toilet outlet of the flush toilet, an extension member having a cylindrical shape defining a drain clearance, a plurality of sealing lips, wherein the extension member projects from said mounting face, wherein an upper portion of the extension member is sealingly receivable inside said floor flange, wherein a lower portion of the extension member having the sealing lips thereon is sealingly receivable inside the soil pipe, said lips forming at least two seal enhancing locations with said soil pipe.

20. The extension sleeve as recited in claim 19, wherein said plurality of sealing lips is at least three sealing lips and wherein said three sealing lips form at least three seal enhancing locations on an interior surface of said soil pipe.

21. A toilet base extension sleeve for sealably attaching a flush toilet having a horn to a floor flange and soil pipe, said toilet base extension sleeve comprising:

a mounting face having a surface for mating with a toilet outlet of the flush toilet, an extension member having a cylindrical shape defining a drain clearance, a plurality of sealing lips, wherein the extension member projects from said mounting face, wherein an upper portion of the extension member is sealingly receivable inside said floor flange, at least three sealing lips attached to said extension member sealingly receivable inside the soil pipe, said lips forming at least three seal enhancing locations with said soil pipe.

* * * * *